US005951143A

United States Patent [19]

Ginsberg

[11] Patent Number: 5,951,143

[45] Date of Patent: Sep. 14, 1999

[54] INFINITY-PROJECTING LIGHT ASSEMBLY

[76] Inventor: Danny R. Ginsberg, 5032 Biloxi St., North Hollywood, Calif. 91601

[21] Appl. No.: 08/953,654

[22] Filed: Oct. 17, 1997

[51] Int. Cl.[6] ..... A63G 31/00

[52] U.S. Cl. ..... 362/140; 362/86; 362/249; 362/806; 40/219; 472/63

[58] Field of Search ..... 362/31, 135, 140, 362/806, 86, 811, 249; 472/63; 40/219; 359/850

[56] References Cited

U.S. PATENT DOCUMENTS

| | | | |
|---|---|---|---|
| 4,164,823 | 8/1979 | Marsico | 40/427 |
| 4,761,004 | 8/1988 | Hargabus | 272/13 |
| 5,787,618 | 8/1998 | Mullis | 40/219 |
| 5,788,579 | 8/1998 | Cherry et al. | 472/63 |
| 5,810,465 | 9/1998 | Hargabus | 362/84 |

*Primary Examiner*—Thomas M. Sember
*Attorney, Agent, or Firm*—Albert O. Cota

[57] ABSTRACT

An infinity-projecting light assembly (10) that is housed in an enclosure (12) that encloses a multiplicity of lamps (70) and passive components (74). Within the enclosure (12) is located a convex mirror that is attached to the enclosure's rear panel (34) and a two-way mirror (94) that is attached to the front ledge (26) of the enclosure (12). The mirrored surfaces of the two mirrors face each other which allows the lamps (70) and passive components (74) to be replicated into a descending visual tunnel that terminates at a perceived infinity point. The assembly (20) incorporates an electrical-control circuit that provides the power to light the interior of the enclosure via a decorative translucent panel (118). The circuit also provides power to a music playback unit, the lamps (70), a light dimming unit and a light blinking unit. The light blinking unit can be set to blink in synchrony with the music from the playback unit.

19 Claims, 5 Drawing Sheets

INFINITY-PROJECTING LIGHT ASSEMBLY

TECHNICAL FIELD

The invention pertains to the general field of meditation and relaxation inducing assemblies and more particularly to such an assembly which utilizes a combination of lights, a convex mirror and a two-way mirror. When the assembly is viewed, the combination presents to a viewer an illusion of a lighted tunnel that vanishes at the rear-center of the assembly.

BACKGROUND ART

Throughout history many different types of art have been developed. Even though some individuals have attempted to classify and group certain styles of art into categories and genres such as decorative art, paintings and pictures, sculptures, etc., there are other types of art that either defy classification or encompass more than one genre. There is also art that has been developed to not only furnish a pleasing aesthetic image but also to provide a functional therapeutic effect upon an individual who view the art.

Of course, many people have claimed to have experienced a genuine emotional or even a physical experience when viewing a particular work of art; and, this may or may not have been an intended goal of the artist. Rather, there have been in the past, and are currently, certain artists who have created art with the dual purpose of producing a beautiful and/or unique image that can also give an individual a genuine, tangible method of relieving a particular ailment or other similar problem.

When considering this therapeutic art it is difficult to define the parameters of the art's capabilities. Some of the examples of this type of art require a person to come into actual physical contact with the object of art, while others simply require a person to gaze meditatively upon the object.

It is this latter example that causes some people to really question the veracity of the artist's intentions. While the other therapeutic art, the type that requires physical contact, may be capable of transferring some form of a "healing" experience through the observer's touch, the second type of art seems to be relaying solely on the power and effect that is produced upon the observer's mind after viewing the object of art. Detractors claim that there is no possible way for art of this "type" to function as described, but, there are also numerous individuals who will swear to the verity of the art's ability.

The basic argument for the use of therapeutic art is that it can cause no harm, regardless of the final outcome. If nothing changes in an observer there has been no significant loss, whereas if a person is able to show improvement, no matter how large or small, then the artist and his/her art has actually accomplished a genuinely positive result.

In conclusion, any art that can even possibly provide a small of amount of therapeutic relief, while at the same time adding beauty to its surroundings, can only be considered a uniquely beneficial product.

A search of the prior art did not disclose any patents that read directly on the claims of the instant invention, however, the following U.S. Pat. Nos. are considered related:

| U.S. Pat. No. | INVENTOR | ISSUED |
|---|---|---|
| 4,859,031 | Berman et al | 22 August 1989 |
| 4,812,028 | Matsumoto | 14 March 1989 |
| 4,761,004 | Harabus | 2 August 1988 |

The 4,859,031 patent discloses an optical collimating apparatus which functions as a heads-up display by utilizing a semi-reflective concave mirror and a cholesteric liquid crystal element. Images generated by an image source are focussed on a transmitter/combiner from where the images are reflected into the line of sight of the observer. The generated images are transmitted by the primarily transmissive (convex) side of the semi-reflective concave mirror to the cholesteric liquid crystal element. The cholesteric liquid crystal element reflects the generated images back toward the reflective (concave) side of the semi-reflective concave mirror, which in turn reflects the images back toward the cholesteric liquid crystal element, which then transmits the generated images to the observer.

The 4,812,028 patent discloses a reflection type projection optical system suitable for projection of a micropattern object and capable of performing reduction projection. The projection optical system includes a first and second optical subsystem which combine to set a Petzval sum to zero. A first optical subsystem forms a reduced image of an object and a second optical subsystem forms a further reduced object image from the image formed by the first optical subsystem.

The 4,761,004 patent discloses an infinity mirror display in which light is introduced between the totally reflecting mirror and the partially reflecting mirror by holes through the totally reflecting mirror. This light may consist of incandescent bulbs extending through the holes or fiber otpics conveying light through the holes form a light source behind the totally reflecting mirror. The light source extends to the partially reflecting mirror to produce images which appear to be a continuous column which diminishes in size and intensity.

For background purposes and as indicative of the art to which the invention is related reference may be made to the remaining cited patents.

| U.S. Pat. No. | INVENTOR | ISSUED |
|---|---|---|
| 5,788,579 | Cherry et al | 4 August 1998 |
| 5,427,628 | Hartley | 27 June 1995 |
| 5,291,340 | Kashima | 1 March 1994 |
| 5,257,139 | Higuchi | 26 October 1993 |
| 5,253,117 | Kashima | 12 October 1993 |
| 5,078,502 | Cook | 7 January 1992 |
| 4,164,823 | Marisco | 21 August 1979 |

DISCLOSURE OF THE INVENTION

The infinity-projecting light assembly is designed as an art form that provides a unique and meditative visual image that can be accompanied by music and lights, wherein the lights can be adjusted to be in synchrony with the music.

In its most basic design, the infinity-projecting light assembly is comprised of:

a) an enclosure having an outward surface, an inward surface, a lower edge, an open front edge, and a rear panel, b) a convex mirror attached to the rear panel of the enclosure. When attached, the mirrored surface of the convex mirror is directed towards the open front edge of the enclosure, c) a multiplicity of electrically operated lamps and passive components attached to the inward surfaces of the enclosure. The lamps are preferably incandescent lamps however, light emitting diodes (LEDs) may also be used, d) a two-way mirror attached to the open front edge of the enclosure. The mirrored surface of the two-way mirror is directed towards the mirrored surface of the convex mirror, and e) base dimensioned to support the lower edge of the enclosure and which and encloses a primary light source that is operated by an electrical power circuit which also operates the multiplicity of lamps. The light from the primary light source illuminates the interior of the enclosure. The convex mirror and the two-way mirror in combination with the multiplicity of lamps and the Passive components create an image that is replicated and reduced proportionally as the image is replicated towards a vanishing point located at the center of the convex mirror.

The above basic design can be enhanced by the addition of a music playback unit, such as a tape or compact disc unit; a light dimming unit and a light blinking unit. The light blinking unit is connected to the lamps and is adjusted to allow the lamps to blink in synchrony with the cadence of the music being played on the music playback unit.

In view of the above disclosure, it is the primary object of the invention to provide an infinity-type light assembly that provides a viewer with a unique infinity illusion that replicates the images that ultimately disappear into a tunnel illusion.

It is also an object of the invention to build an infinity-type light assembly that is constructed in a unique design configuration. The assembly is preferably made from either a single or combination of various exotic wood(s) that add to the aesthetics of the assembly. However, a mass produced assembly can easily be constructed of a plastic material It is a further object of the invention to provide an alternative infinity-type light assembly to the currently-available, mass-produced, infinity lights. The instant invention can be custom made in whatever enclosure shape and type of wood a customer might specify.

It is yet another object of the invention to provide an assembly that can provide a profound sense of serenity and calm for a viewer. The instant invention can be used as a device to assist in inducing a meditative state after a certain amount of concentration has been directed at the assembly.

It is still a further object of the invention to provide a high-quality piece of artwork, as a result of the quality of craftsmanship and the unique design of the assembly and materials used in its construction, The assembly can easily be displayed in a place of prominence or among other higher-end works of art and not be considered out of place.

A further object of the invention is to allow the light assembly to function as a point-of-purchase display. In this case, an article for sale is placed within the enclosure to allow the article to be replicated towards a vanishing point.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
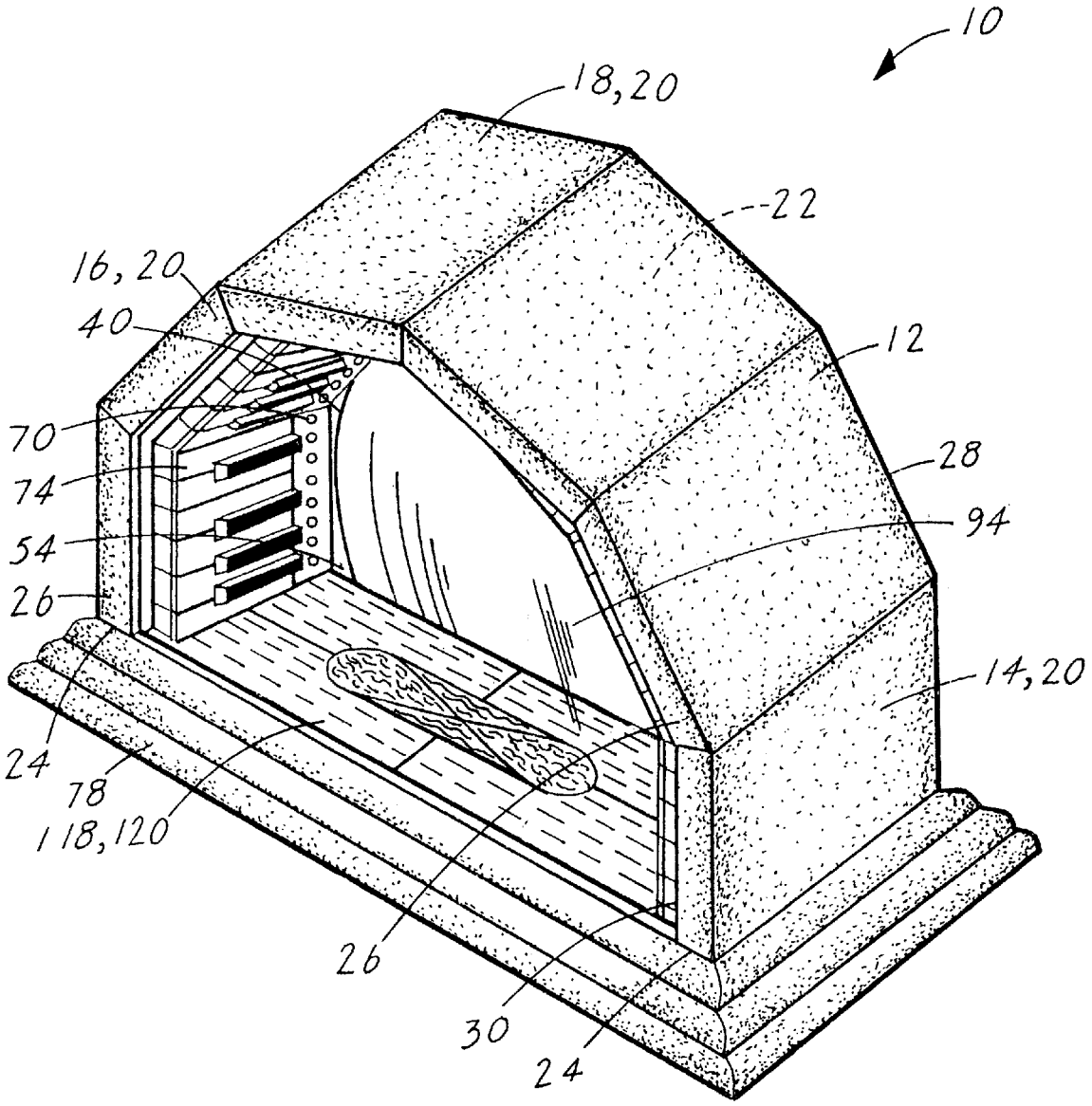
FIG. 1 is a perspective view of the infinity-projecting light assembly.

The best mode for carrying out the invention is presented in terms of a preferred embodiment for an infinity-projecting light assembly. The assembly utilizes a combination of lights, mirrors and passive images to provide what is referred to as an infinity effect. The infinity effect essentially allows a person who is viewing the assembly to see an image that is reflected and reduced proportionally as the image is replicated towards a vanishing point.

The preferred embodiment of the infinity-projecting light assembly 10, is comprised of the following major elements: an enclosure 12, a rear panel 34, a convex mirror 46, a flat border mirror 54, a reflective plastic strip 62, lamps 70, passive components 74, a base 78, a two-way mirror 94, a bottom plate 98, a primary light source 108, a translucent panel 118, and an electrical power circuit 126.

Figure 3:
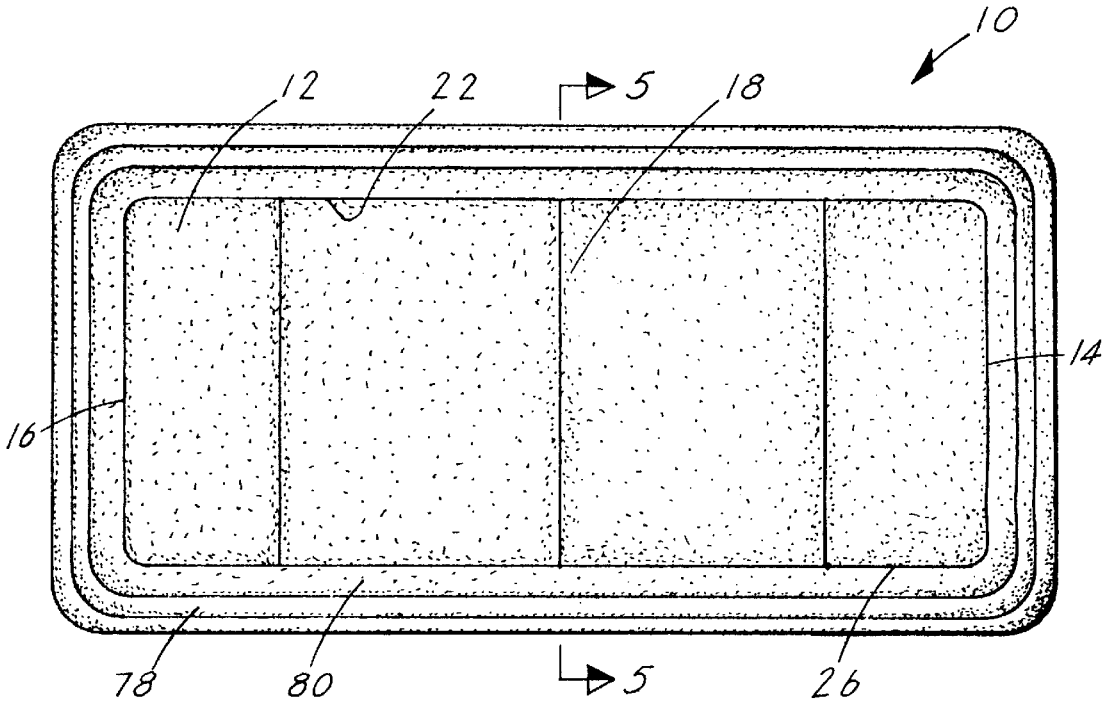
FIG. 3 is an upper plan view of the assembly.
Figure 2:
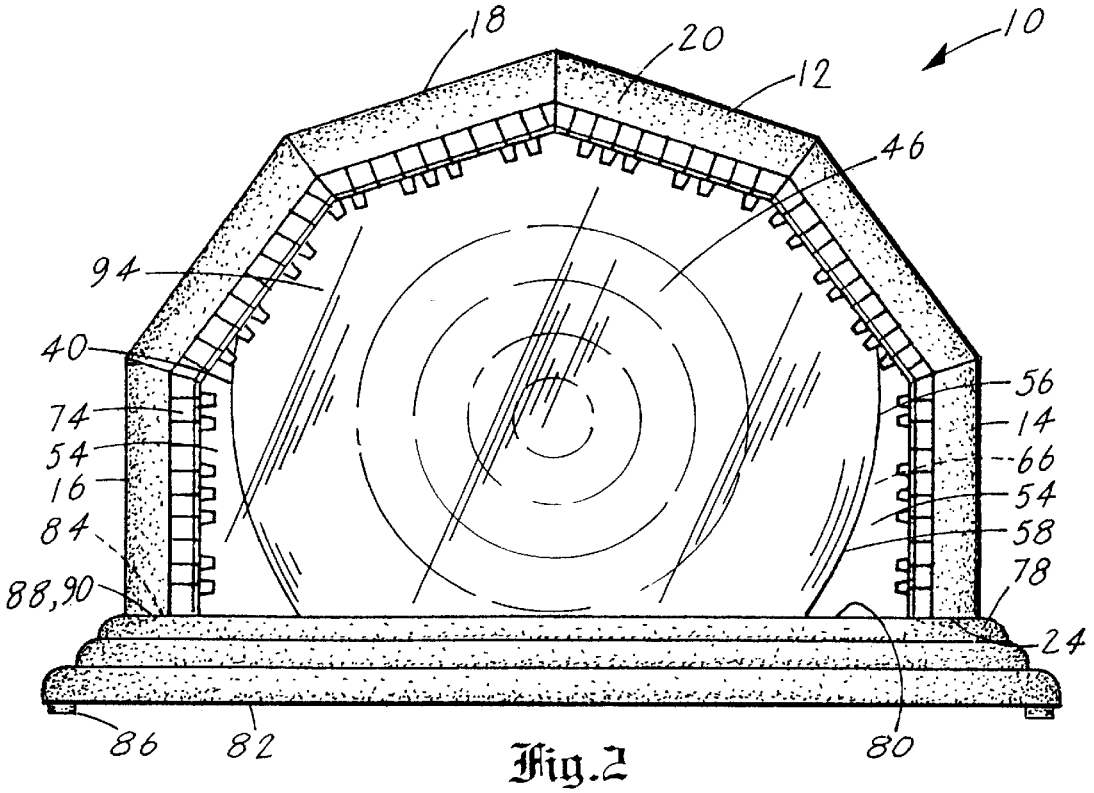
FIG. 2 is a front elevational view of the assembly showing the relative placement of the convex mirror, the flat border mirror, the lamps and the passive components.
Figure 5:
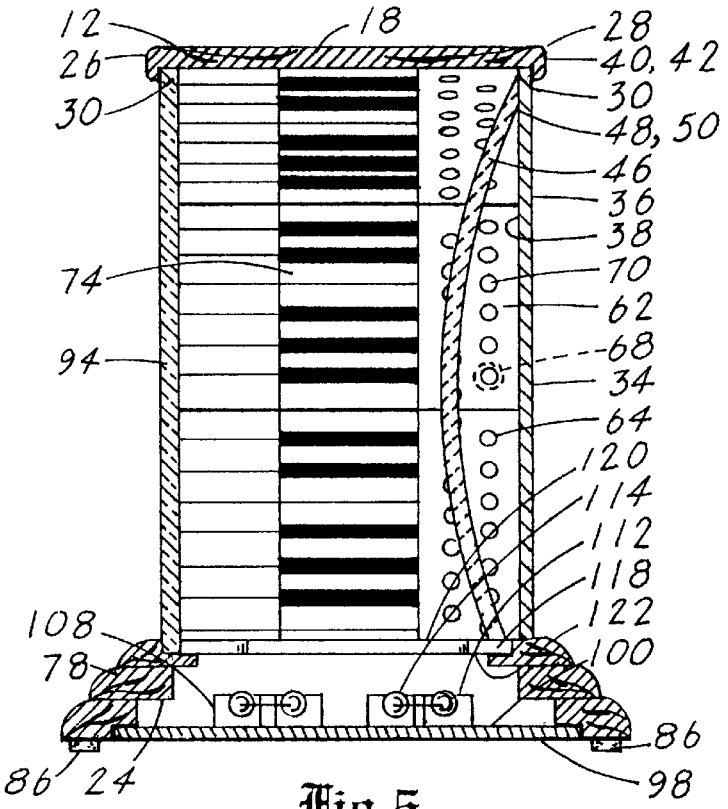
FIG. 5 is a cross-sectional view of the assembly taken along the lines 5—5 of FIG. 3.

The assembly 10 can be constructed in a variety of shapes and sizes, but, regardless of the shape and/or size, the assembly always includes an enclosure 12, as shown in FIGS. 2 and 3. The enclosure 12 is comprised of a right section 14, a left section 16 and an upper section 18. Each of these sections has an outward surface 20, an inward surface 22, a lower edge 24, a front edge 26 and a rear edge 28. The front edge 26 and the rear edge 28 further have an inward extending ledge 30 as shown in FIG. 5. The combination of these elements, usually in a geometric shape, comprises the enclosure 12.

The rear panel 34 of the assembly 10, as best shown in FIG. 5, is dimensioned to fit into the inward extending ledge 30, located on the rear edge 28. The rear panel 34 also has an outer surface 36, an inner surface 38, and is removably attached by an attachment means 40 which preferably consists of a plurality of fasteners 42 as also shown in FIG. 5.

In order to create the reflecting image of the infinity effect, mirrors must be placed in a precise arrangement. The convex mirror 46, as shown in FIGS. 1, 2 and 5, which may be made from a glass or plastic substrate, is vertically and centrally attached by an attachment means 48, such as an adhesive 50, to the inner surface 38 of the rear panel 34 as also shown in FIG. 5. The mirrored surface of the convex mirror is then directed towards the front edge 26 of the enclosure 12. The flat border mirror 54, as shown in FIGS. 1 and 2, is also attached by the attachment means 48 such as the adhesive 50, to the inner surface 38 of the rear panel 34. The flat border mirror 54 is designed with a central opening 56 that fits along the edges of the convex mirror 46, and the outer edges 58 fit against the inward surface 22 of the enclosure 12. The combination of the convex mirror 46 and flat border mirror 54, comprise the rear reflecting surface of the enclosure 12.

To further complete the reflecting image, the reflective plastic strip 62, as shown best in FIG. 5 is attached by an attachment means 66, to the inward surface 22 of the enclosure 12 as shown in FIGS. 1 and 2. The plastic strip 62 includes a multiplicity of bores 64 therethrough into which are inserted and attached by friction, a like multiplicity of the electrically operated lamps 70, which may be comprised of incandescent lamps or light emitting diodes (LEDs). The attachment means 66, for attaching the plastic strip 62, may also include a plurality of spacers 68. These spacers 68 are attached by an adhesive and function to create a space between the plastic strip 62 and the assembly 10. This space is utilized to enclose and route electrical wires that are connected to the lamps 70 from the electrical power circuit 126, which is described infra.

In order to provide part of the image that is reflected and replicated, in addition to the lights, a plurality of passive components 74 are located along the inward surface 22 of the enclosures 12 as shown in FIGS. 1, 2 and 5. The passive components 74 may be constructed of a translucent material that is back-lighted by lamps that are illuminated by the electrical circuit 126, described infra. The components 74 are attached adjacent to the reflective plastic strip 62 by an adhesive 50.

The lower section of the enclosure 12 is comprised of the rectangular boxed base 78. As shown in FIGS. 1, 2 and 3, the base 78 has an upper surface 80 and a lower surface 82. Each of the surfaces 80, 82 respectively have an inward extending ledge 84. Attached to each corner of the lower surface 82 is a pad 86, as shown in FIGS. 2 and 5. The base 78 is dimensioned to receive the lower edges 24 of the enclosure 12, which are attached to the base 78 by an attachment means 88, such as screws 90.

The second mirror which is used to produce the infinity effect is the two-way mirror 94 which is comprised of a solar-reflective glass. The mirror is dimensioned to be held in place when inserted into the inward extending ledge 30 located on the front edges 26 of the enclosure 12 as shown in FIGS. 1, 2 and 5. When attached, the mirrored surface of the two-way mirror 94 is directed towards the mirrored surface of the convex mirror 46.

Figure 4:
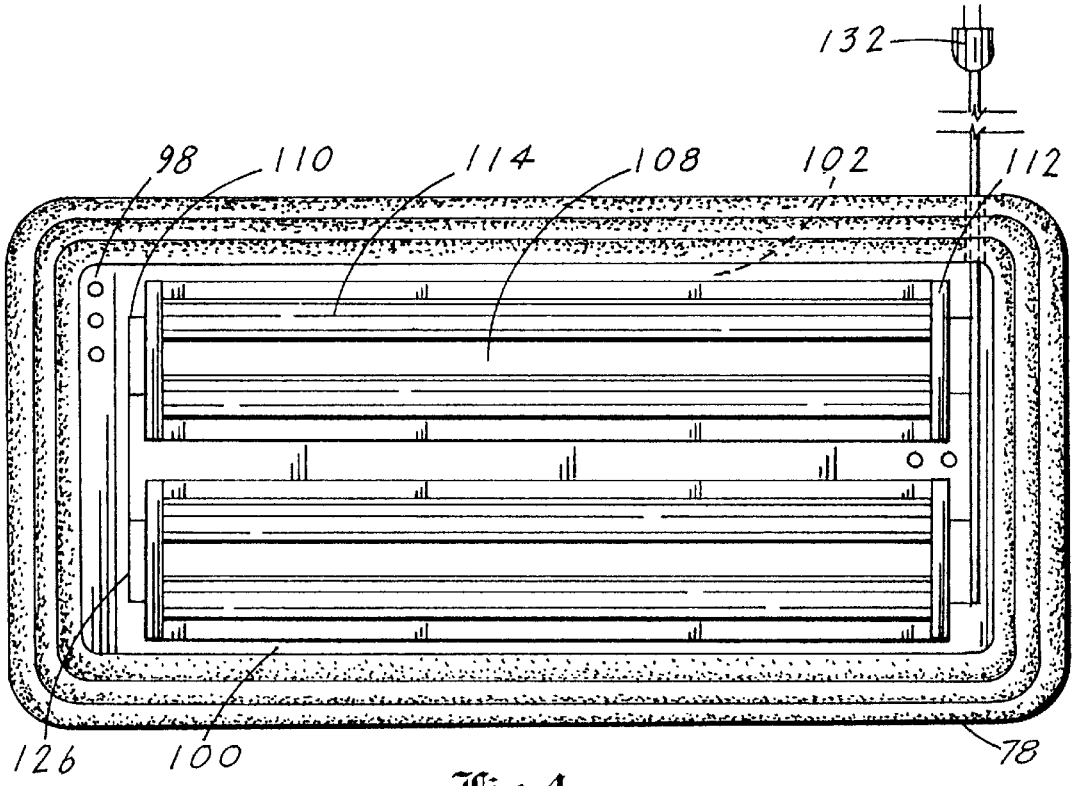
FIG. 4 is a top plan view of the base showing the placement of two fluorescent lamp mounting bases wherein each base accepts two fluorescent lamps.

As shown in FIGS. 4 and 5, the bottom plate 98 which is preferably perforated and has an upper surface 100 and a lower surface 102, is dimensioned to be attached by a plurality of fasteners 104 to the inward extending ledge 84 on the lower surface 82 of the base 78.

As shown in FIG. 4, there is at least one primary light source 108 attached by an attachment means 110 to the upper surface 100 of the perforated bottom plate 98. The light source 108 is comprised of either a fluorescent lamp mounting base 112 that is designed to accommodate two fluorescent light bulbs 114 or two side-by-side fluorescent lamp mounting bases 112, with each base designed to accommodate two fluorescent light bulbs 114. The mounting base 112 is attached to the upper surface 100 of the bottom plate 98 and is connected to the electrical power circuit 106 described infra.

Located above the light source 108 is the translucent panel 118, as shown in FIGS. 1 and 5. The panel 118 has an upper surfacer 120 and a lower surface 122, and is preferably comprised of a multi-colored stained-glass. The panel 118 is dimensioned to fit into the inward extending ledge 84 on the upper surface 80 of the base 78, and is held therein by the lower edges 24 of the enclosure 12. The panel 118 is designed to allow the light from at least one light source 108 to pass through the translucent panel 118 and illuminate the interior of the enclosure 12.

In order to provide power to the assembly 10, the electrical power circuit 126 is located within the base 78 of the enclosure 12, as shown in FIG. 4. The power circuit 126 is designed to apply power to the plurality of lamps 70 and at least one primary light source 108. The power circuit 126 is operated from a utility power source 150, which is applied to the circuit 126 through a power switch 128 and a fuse 130. When the power circuit 126 illuminates the multiplicity of lamps 70 and the primary light source 108, the light from the light source illuminates the interior of the enclosure 12.

The combination of the convex mirror 46, the two-way mirror 94 and the multiplicity of lamps 70, along with the passive components 74, creates the image that is reflected and reduced proportionally as the image is replicated toward a vanishing point located at the center of the convex mirror 46.

The visual dynamics of the reflected-image that is replicated by the assembly 10 is described by reference to FIG. 6 and the following set of equations:

$$I_1=L_1=\text{Direct Image}$$

$$I_2=L_2+L_3+L_4$$

$$I_3=L_2+L_3+L_5+L_6+L_7$$

$$I_4=I_1=L_1$$

where: I=Image
L=Light path
$F_p$=Focal Point
$O_a$=Optical Axis

Figure 6:
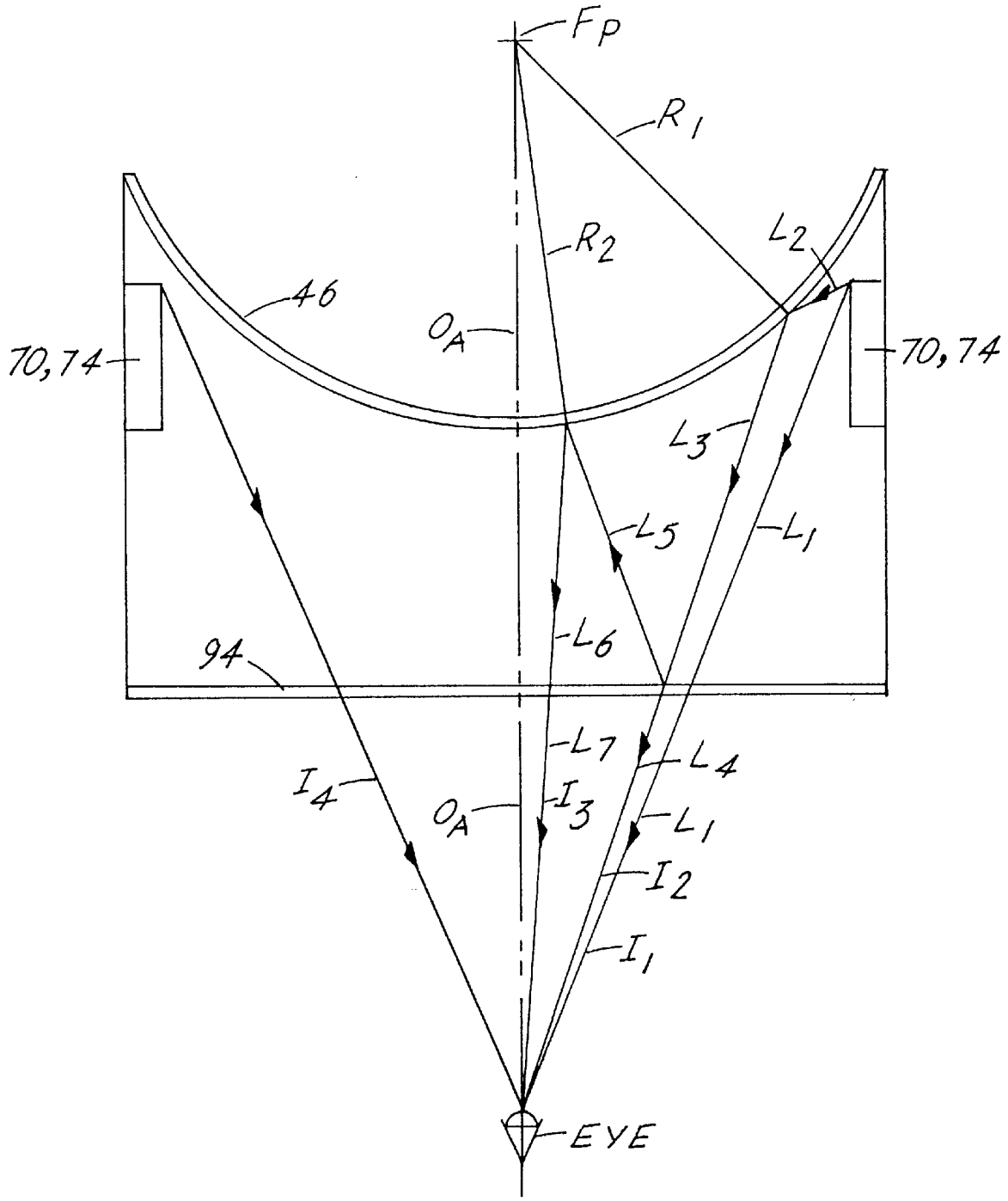
FIG. 6 is an optical schematic showing a portion of the reflective paths of the convex and the two-way mirror.

When viewing the assembly 10 up to twelve replications of the image can seen on the assembly 10, however, for purposes of explanation, the image replications, as shown in FIG. 6, are limited to three images: $I_1$, $I_2$ and $I_3$. Also, for clarity, only the images on the right side of the optical axis $O_a$ are included. The image $I_4$, which is shown for reference, is equal to $I_1$which is equal to $L_1$, which corresponds to the direct image.

On the upper end of FIG. 6, is the focal point $F_p$ followed in sequence by the convex mirror 46, the two-way mirror 94 and the viewer's eye. The image which consists of the lamps 70 and the passive components 74 is located between the convex mirror 46 and the two-way mirror 94.

The first image $I_1$ which is the direct image and the one that appears closest to the eyes, consists of the light path $L_1$; the second image $I_2$ consists of the light paths $L_2+L_3+L_4$ and the third image $I_3=L_2+L_3+L_5+L_6+L_7$.

Figure 7:
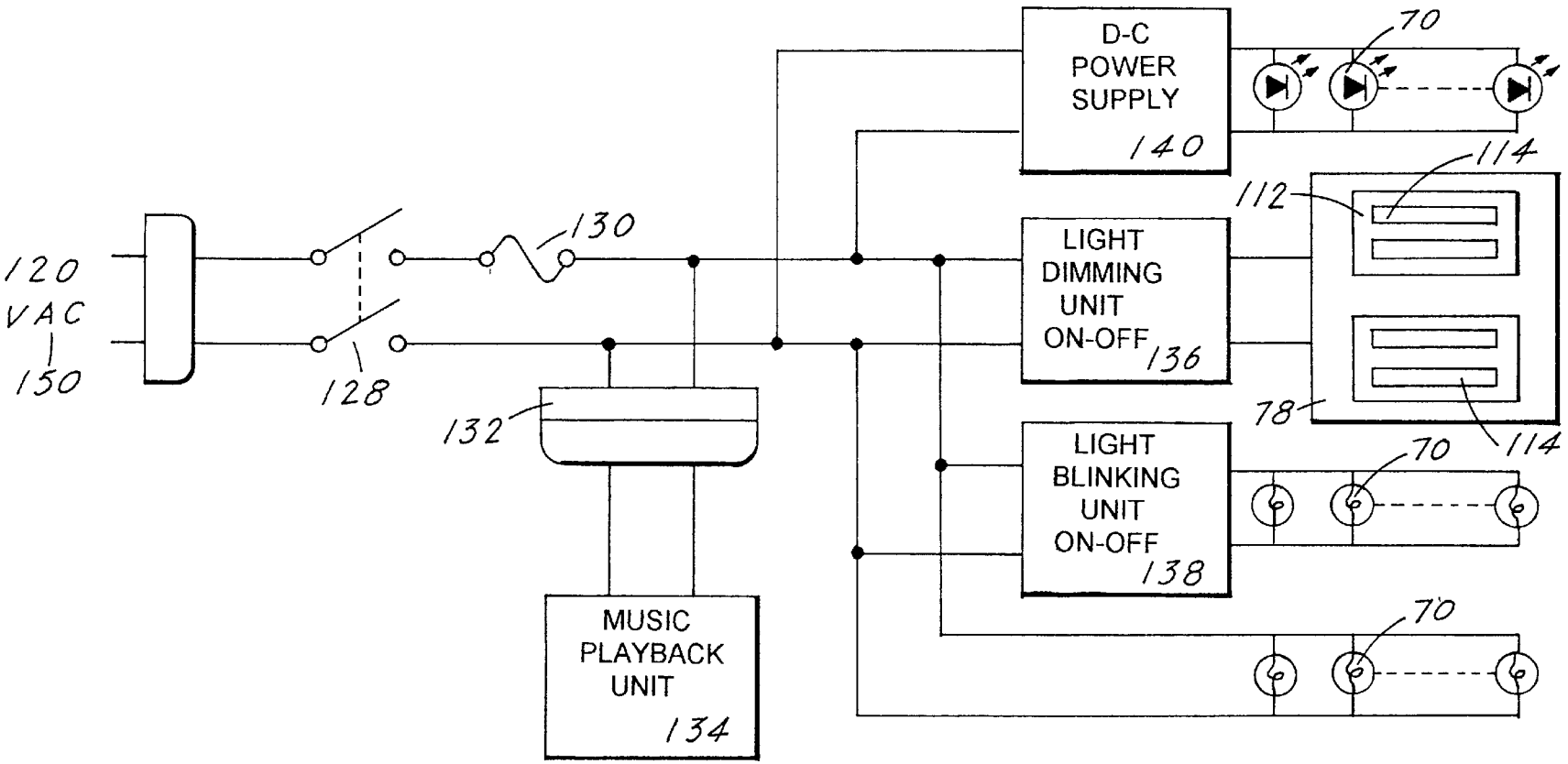
FIG. 7 is a block diagram of the electrical power circuit which can be designed to accommodate light enhancing units and a music playback unit.

The assembly 10 further comprises an a-c power receptacle 132 that is connected to the electrical power circuit 126, as shown in the block diagram of FIG. 7. A music playback unit 134, such as a tape playback unit or compact disc playback unit, can be connected to the power circuit 126. The power circuit 126 can also be connected to a light dimming unit 136 that controls the brightness of the primary light source 108. A light blinking unit 138, which is connected to the power source 126 as well, is connected to the incandescent lamps 70 and, when the blinking unit 138 is adjusted, the lamps 70 will blink in synchrony with the cadence of the music being played on the music playback unit 134.

In order to produce the required d-c voltage to operate the plurality of light emitting diodes (LEDs), the power circuit 126 is further comprised of a d-c power supply 140.

While the invention has been described in complete detail and pictorially shown in the accompanying drawings it is not to be limited to such details, since many changes and modifications may be made to the invention without departing from the spirit and the scope thereof. For example, in addition to the lamps 70 and passive components 74, a pump-operated sealed water-containment structure 76 could easily be attached to the inward surface 22 of the enclosure 12. When the pump is activated by the electrical power circuit 126, the water would flow in a circular pattern around the water-containment structure 76. Hence, it is described to cover any and all modifications and forms which may come within the language and scope of the claims.

I claim:

1. An infinity-projecting light assembly comprising:

a) an enclosure having a right section, a left section and an upper section, wherein each of the sections have an outward surface, an inward surface, a lower edge, a front edge and a rear edge with the front edge and rear edge further having an inward extending ledge, b) a rear panel dimensioned to fit into the inward extending ledge on the rear edge of said enclosure, wherein said rear panel has an outer surface, an inner surface, and is removably attached by an attachment means, c) a convex mirror vertically and centrally attached by an attachment means to the inner surface of said rear panel, with the convex mirror surface directed towards the front edge of said enclosure, d) a flat border mirror having a central opening that fits along the edges of said convex mirror and having outer edges that fit against the inward surface of said enclosure, wherein said flat mirror is attached, by an attachment means, to the inner surface of said rear panel, e) a reflective plastic strip attached, by an attachment means, to the inward surface of said assembly with said plastic strip having a multiplicity of bores therethrough into which are inserted and attached by friction, a like multiplicity of electrically operated lamps, f) a plurality of passive components located adjacent to said reflective plastic strip and attached, by an attachment means, to the inward surface of said enclosure, g) a rectangular boxed base having an upper surface and a lower surface, with each surface having an inward extending ledge and wherein to each corner of said lower surface is attached a pad, wherein said base is dimensioned to receive the lower edges of said enclosure which are attached to said base by an attachment means, h) a two-way mirror dimensioned to be held in-place when inserted into the inward extending ledge located on the front edges of said enclosure and on said base, wherein the mirrored surface of said two-way mirror is directed towards the mirrored surface of said convex mirror, i) a bottom plate having an upper surface and a lower surface, wherein said plate is dimensioned to be attached by a plurality of fasteners to the inward extending ledge on the lower surface of said base, j) at least one primary light source attached, by an attachment means, to the upper surface of said bottom plate, k) a translucent panel having an upper surface and a lower surface, wherein said translucent panel is dimensioned to fit into the inward extending ledge on the upper surface of said base and is held therein by the lower edges of said enclosure, wherein said panel allows the light from the at least one primary light source to pass through said translucent panel and illuminate said enclosure, and l) an electrical power circuit located, within said base and said enclosure, that applies power to said plurality of lamps and said at least one primary light source, wherein said electrical power circuit is operated from a utility power source which is applied to said circuit through a power switch and a fuse, wherein when said electrical power circuit illuminates said multiplicity of lamps and said primary light source the light from the primary light source illuminates the interior of said enclosure, wherein the combination of said convex mirror, said two-way mirror said multiplicity of lamps and said passive components creates an image that is replicated and reduced proportionally as the image is replicated toward a centrally located vanishing point located on said convex mirror.

2. The assembly as specified in claim 1 wherein said means for removably attaching said rear panel to the rear edges of said enclosure comprises a plurality of fasteners.

3. The assembly as specified in claim 1 wherein said means for attaching said convex mirror and said flat mirror to the inner surface of said rear panel comprises an adhesive.

4. The assembly as specified in claim 1 wherein said means for attaching said reflective plastic strip to the inward surface of said assembly comprises a plurality of spacers that are attached on each end by an adhesive, wherein said spacers create a space between said plastic strip and said assembly that is used to enclose and route the electrical wires, from said electrical power circuit, that are connected to said lamps.

5. The assembly as specified in claim 4 wherein said lamps are comprised of incandescent lamps.

6. The assembly as specified in claim 4 wherein said lamps are comprised of light emitting diodes (LEDs).

7. The assembly as specified in claim 1 wherein said means for attaching said plurality of passive components to the inward surfaces of said enclosure comprises an adhesive.

8. The assembly as specified in claim 7 wherein said passive components may be constructed of a translucent material and are back lighted by lamps that are illuminated by said electrical power circuit.

9. The assembly as specified in claim 1 wherein said two-way mirror is comprised of a solar-reflective glass having a mirror surface.

10. The assembly as specified in claim 1 wherein said convex mirror is made from a glass substrate.

11. The assembly as specified in claim 1 wherein said convex mirror is made from a plastic substrate.

12. The assembly as specified in claim 1 wherein said translucent panel is comprised of a multi-colored stained-glass.

13. The assembly as specified in claim 1 wherein said at least one primary light source is comprised of a fluorescent lamp mounting base designed to accommodate two fluorescent light bulbs, wherein said mounting base is attached to the upper surface of said bottom plate and is connected to said electrical power circuit.

14. The assembly as specified in claim 1 wherein said primary light source is comprised of two side-by-side fluorescent lamp mounting bases wherein each base is designed to accommodate two fluorescent light bulbs, wherein said two bases are attached to the upper surface of said bottom plate and are connected to said electrical power circuit.

15. The assembly as specified in claim 1 wherein said assembly further comprises an a-c power receptacle that is connected to said electrical power circuit, where into said receptacle can be connected a music playback unit.

16. The assembly as specified in claim 15 wherein said music playback unit is comprised of a tape playback unit or a compact disc playback unit.

17. The assembly as specified in claim 1 wherein said electrical power circuit is further comprised of a light dimming unit that controls the brightness of said primary light source.

18. The assembly as specified in claim 17 wherein said electrical power circuit is further comprised of a light blinking unit that is connected to said incandescent lamps, wherein said light blinking unit is adjusted to allow said lamps to blink in synchrony with the music being played on said music playback unit.

19. The assembly as specified in claim 18 wherein said electrical power circuit is further comprised of a d-c power supply that is connected to said electrical power circuit, wherein said d-c power supply produces the required d-c voltage to operate said plurality of light emitting diode (LEDs).

* * * * *